US009108411B2

(12) United States Patent
Shindo

(10) Patent No.: US 9,108,411 B2
(45) Date of Patent: Aug. 18, 2015

(54) MAINTENANCE METHOD FOR LIQUID JETTING APPARATUS AND LIQUID JETTING APPARATUS

(75) Inventor: Tatsuya Shindo, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 281 days.

(21) Appl. No.: 12/869,223

(22) Filed: Aug. 26, 2010

(65) Prior Publication Data

US 2011/0050797 A1 Mar. 3, 2011

(30) Foreign Application Priority Data

Aug. 31, 2009 (JP) ..... 2009-199974

(51) Int. Cl.
*B41J 2/165* (2006.01)

(52) U.S. Cl.
CPC ..... *B41J 2/16532* (2013.01)

(58) Field of Classification Search
None
See application file for complete search history.

(56) References Cited

U.S. PATENT DOCUMENTS 6,783,205 B2 * 8/2004 Saijo et al. ..... 347/30
7,131,720 B2 * 11/2006 Mizuno et al. ..... 347/92
2002/0126175 A1 * 9/2002 Shima ..... 347/29
2007/0296754 A1 12/2007 Hiraki et al.
2008/0150973 A1 * 6/2008 Seki et al. ..... 347/7
2009/0015643 A1 1/2009 Hosono

FOREIGN PATENT DOCUMENTS

JP 2000108368 A 4/2000
JP 2007-331269 12/2007
JP 2008238431 A 10/2008
JP 2009-18447 1/2009

OTHER PUBLICATIONS

Japanese Notice of Reasons for Rejection mailed Jan. 22, 2013 with partial English Translation.

* cited by examiner

*Primary Examiner* — Alejandro Valencia
(74) *Attorney, Agent, or Firm* — Scully, Scott, Murphy & Presser, P.C.

(57) ABSTRACT

A maintenance method which is used for a liquid jetting apparatus provided with a jetting head which has a nozzle surface formed with nozzle holes and which jets a liquid from the nozzle holes and a cap which covers the nozzle surface, includes: detecting a temperature in the liquid jetting apparatus; discharging the liquid in the jetting head from the nozzle holes into the cap in a state that the nozzle surface of the jetting head is covered with the cap; sucking the liquid discharged into the cap via a discharge hole provided at a bottom portion of the cap in a state that the cap is separated from the jetting head; and determining a suction amount for sucking the liquid discharged into the cap per a predetermined period of time based on the detected temperature.

4 Claims, 8 Drawing Sheets

MAINTENANCE METHOD FOR LIQUID JETTING APPARATUS AND LIQUID JETTING APPARATUS

CROSS REFERENCE TO RELATED APPLICATION

The present application claims priority from Japanese Patent Application No. 2009-199974 filed on Aug. 31, 2009, the disclosures of which are incorporated herein by reference in their entirety.

BACKGROUND OF THE INVENTION

1. Field of the Invention

The present invention relates to a maintenance method for a liquid jetting apparatus, in particular, an idle suction method for sucking and discharging a liquid accumulated in a cap after performing a purge by covering a jetting head provided for a liquid jetting apparatus with the cap, and the liquid jetting apparatus.

2. Description of the Related Art

In the conventional liquid jetting apparatus exemplified by a printer apparatus based on the ink-jet system, for example, a plurality of nozzle holes are formed on a nozzle surface of a jetting head, and a liquid such as an ink or the like is jetted from the nozzle holes. When the liquid jetting apparatus is used after a long period of time in which the liquid jetting apparatus is not used, the purge process is performed to suck out the remaining liquid by a suction pump in order to discard any deteriorated liquid remaining in the nozzle holes of the jetting head.

In order to perform the purge process, for example, the conventional ink-jet printer is provided with a cap for covering the nozzle surface. Further, a discharge hole, which is formed at a bottom portion of the cap, is connected to the suction pump via an ink flow passage. The suction pump is driven to generate the negative pressure in the cap in a state that the nozzle surface is covered with the cap so that the nozzle holes are surrounded inside. Accordingly, the purge process is performed, in which the liquid in the nozzle holes is sucked out into the cap.

If the liquid, which is accumulated in the cap by the purge process, is remained as it is, the liquid-accommodating capacity in the cap is lowered when the next purge process is performed. Further, the discharge hole formed at the bottom portion of the cap and the ink flow passage may be clogged up. A possibility arises such that the purge process cannot be executed appropriately in the next time and the followings. Therefore, in the conventional ink-jet printer, the suction pump is driven (to perform the idle suction) in a state that the cap is separated from the nozzle surface after completing the purge process, and thus the liquid, which is accumulated in the cap, is discharged to the outside of the cap via a tube.

When the idle suction is executed, if the suction speed (i.e., the pump suction amount per unit time) is not appropriate, then the opening, which is communicated with the discharge hole, is formed at the liquid surface of the liquid accumulated on the inner bottom portion of the cap in some cases.

If such an opening is formed, even when the suction pump is driven to perform the idle suction, then only the air is sucked through the opening. Once the suction of the air starts through the opening, the movement of the surrounding liquid, which is to be brought about in the direction to close the opening, is inhibited by the flow of the air. As a result, the opening is hardly closed. Therefore, the period of time, in which only the air is sucked, is prolonged, and it is difficult to efficiently discharge the liquid contained in the cap.

It is considered that such a phenomenon results from the viscosity (fluidity) of the liquid and the suction speed of the pump. The liquid jetting apparatus is used in a variety of temperature environments. The liquid jetting apparatus is used in a relatively low temperature environment in some cases, and the liquid jetting apparatus is used in a relatively high temperature environment in other cases. The viscosity of the liquid (especially the ink) is changed depending on the temperature environment in which the liquid jetting apparatus is used. Therefore, if the suction speed during the idle suction is constant, for example, when the liquid jetting apparatus is used in a low temperature environment in which the viscosity of the liquid is high, then a possibility arises such that the idle suction cannot be performed appropriately. It is affirmed that such a circumstance also arises similarly in any liquid jetting apparatus for jetting any other liquid, without being limited to the printer apparatus for jetting the ink.

SUMMARY OF THE INVENTION

In view of the above, an object of the present invention is to provide an idle suction method and a liquid jetting apparatus in which the idle suction can be appropriately performed after the purge irrelevant to any change of the environmental temperature.

According to a first aspect of the present invention, there is provided a maintenance method which is used for a liquid jetting apparatus provided with a jetting head which has a nozzle surface formed with nozzle holes and which jets a liquid from the nozzle holes and a cap which covers the nozzle surface, the maintenance method including: detecting a temperature in the liquid jetting apparatus; discharging the liquid in the jetting head from the nozzle holes into the cap in a state that the nozzle surface of the jetting head is covered with the cap; sucking the liquid discharged into the cap via a discharge hole provided at a bottom portion of the cap in a state that the cap is separated from the jetting head; and determining a suction amount for sucking the liquid discharged into the cap per a predetermined period of time based on the detected temperature.

According to a second aspect of the present invention, there is provided a liquid jetting apparatus which jets a liquid, including: a jetting head which has a nozzle surface formed with a plurality of nozzle holes and which jets the liquid from the nozzle holes; a cap which has a bottom portion formed with a discharge hole and which covers the nozzle surface of the jetting head; a sucking mechanism which sucks the liquid in the cap via the discharge hole; a moving mechanism which moves the cap between a capping position at which the cap covers the nozzle holes and a retracted position at which the cap is separated from the jetting head; a temperature sensor which detects a temperature in the liquid jetting apparatus; and a controller which controls the jetting head, the sucking mechanism, and the moving mechanism, wherein the controller controls the moving mechanism to move the cap to the capping position; the controller controls one of the jetting head and the sucking mechanism to discharge the liquid in the jetting head from the nozzle holes into the cap; the controller controls the moving mechanism to move the cap to the retracted position; the controller controls the sucking mechanism to suck the liquid discharged into the cap via the discharge hole; and the controller determines a suction amount for sucking the liquid discharged into the cap per a predetermined period of time based on the temperature detected by the temperature sensor.

According to the first and second aspects of the present invention, the appropriate suction amount per the predetermined period of time is determined depending on the temperature environment in the liquid jetting apparatus. Therefore, the liquid discharged into the cap can be reliably sucked. In the following description, the suction, which is performed to suck the liquid discharged into the cap by driving the sucking mechanism connected to the cap in the state that the cap is separated from the nozzle surface of the jetting head, is referred to as "idle suction".

BRIEF DESCRIPTION OF THE DRAWINGS

FIG. 4 shows an example of the correlation between the detected environmental temperature and the suction speed of a suction pump determined depending thereon, and an example of the correlation between the environmental temperature and the total suction volume of the suction pump determined depending thereon as described later on.

FIG. 5 schematically shows states provided in the middle of the idle suction for the ink in a cap, wherein

DESCRIPTION OF THE PREFERRED EMBODIMENTS

An explanation will be made below with reference to the drawings about a liquid jetting apparatus and a maintenance method, in particular, an idle suction method after a purge according to an embodiment of the present invention, as exemplified by an exemplary case in which the present invention is applied to a printer apparatus based on the ink-jet system (hereinafter referred to as "printer apparatus") as an example of the liquid jetting apparatus.

Figure 1:
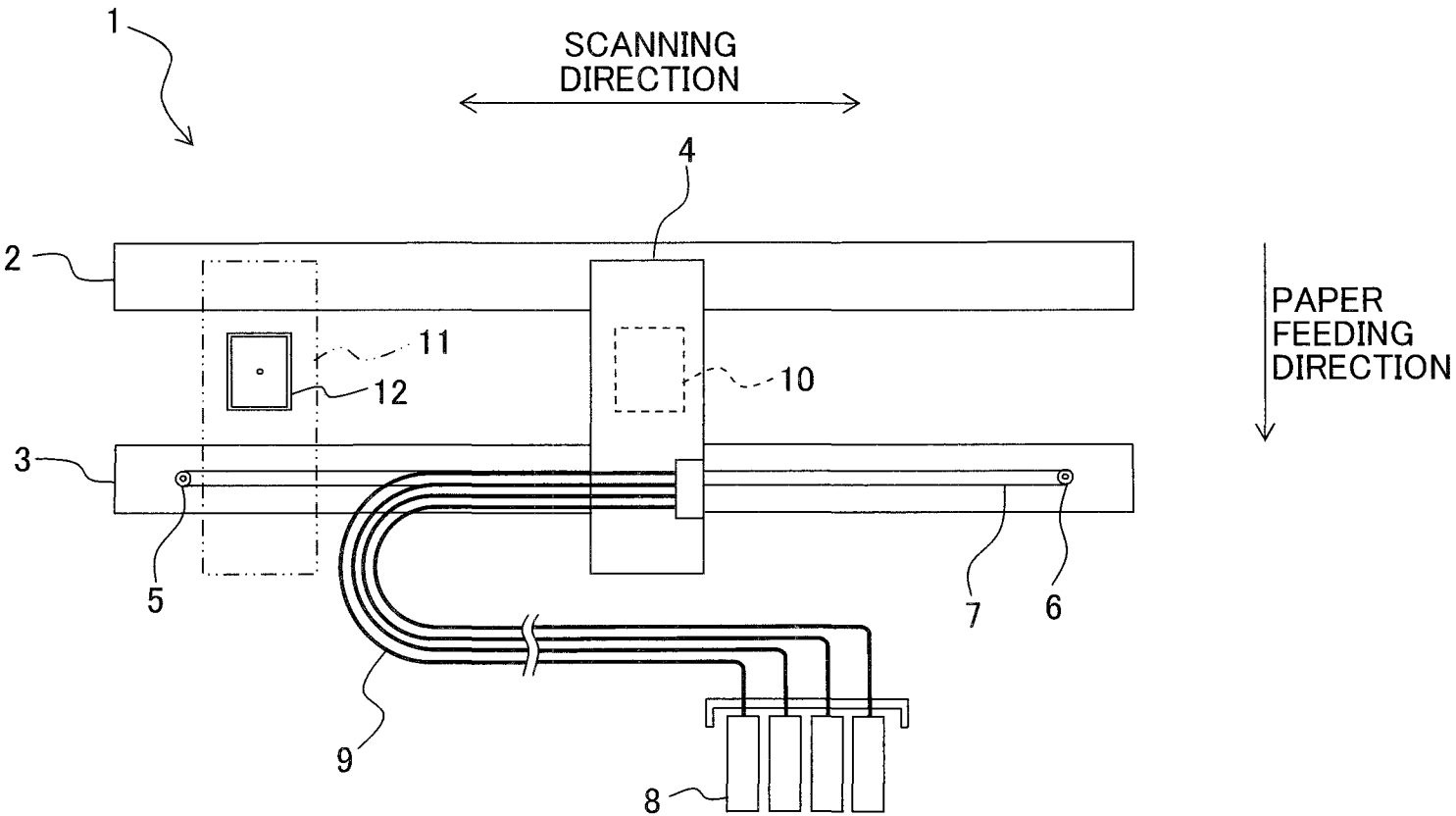
FIG. 1 shows a schematic plan view illustrating main components of a printer apparatus as a liquid jetting apparatus.

At first, an overall arrangement of the printer apparatus 1 will be explained. As shown in FIG. 1, a pair of guide rails 2, 3, which extend in the left-right direction, are arranged substantially in parallel for the printer apparatus 1. A liquid supply unit 4 is supported by the guide rails 2, 3 so that the liquid supply unit 4 is slidable in a scanning direction (left-right direction in FIG. 1). A pair of pulleys 5, 6 are provided in the vicinity of left and right end portions of the guide rail 3. The liquid supply unit 4 is joined to a timing belt 7 applied and wound around the pulleys 5, 6. A motor (not shown), which is driven and rotated in the positive or negative (clockwise or counterclockwise) direction, is provided for the one pulley 6. When the pulley 6 is driven and rotated in the positive or negative direction, the timing belt 7 is reciprocatively moved in the leftward direction or the rightward direction. Accordingly, the liquid supply unit 4 is reciprocatively scanned in the left-right direction along with the guide rails 2, 3.

Four ink cartridges 8 are attached to the printer apparatus 1 so that the four ink cartridges 8 are detachable for the exchange. Four flexible ink supply tubes 9 are connected to the liquid supply unit 4 in order to supply four color inks (for example, black, cyan, magenta, and yellow) from the ink cartridges 8 respectively. A jetting head 10 (see FIG. 2), which has a rectangular shape as viewed in a plan view, is carried under or below the liquid supply unit 4. The inks (liquids) are jetted from the jetting head 10 toward a recording medium (for example, recording paper) which is transported in the direction (paper feeding direction) perpendicular to the scanning direction thereunder or therebelow. Thus, an image is formed on the recording medium.

The maintenance position 11 (position indicated by two-dot chain lines in FIG. 1) is provided at one end of the scanning range of the liquid supply unit 4. A cap 12, which is used when the purge process is performed, is arranged thereunder or therebelow. For example, when the printer apparatus 1 is used again after a long period of time in which the printer apparatus 1 is not used, for example, the purge process is executed for the liquid supply unit 4 at the maintenance position 11.

Figure 2:
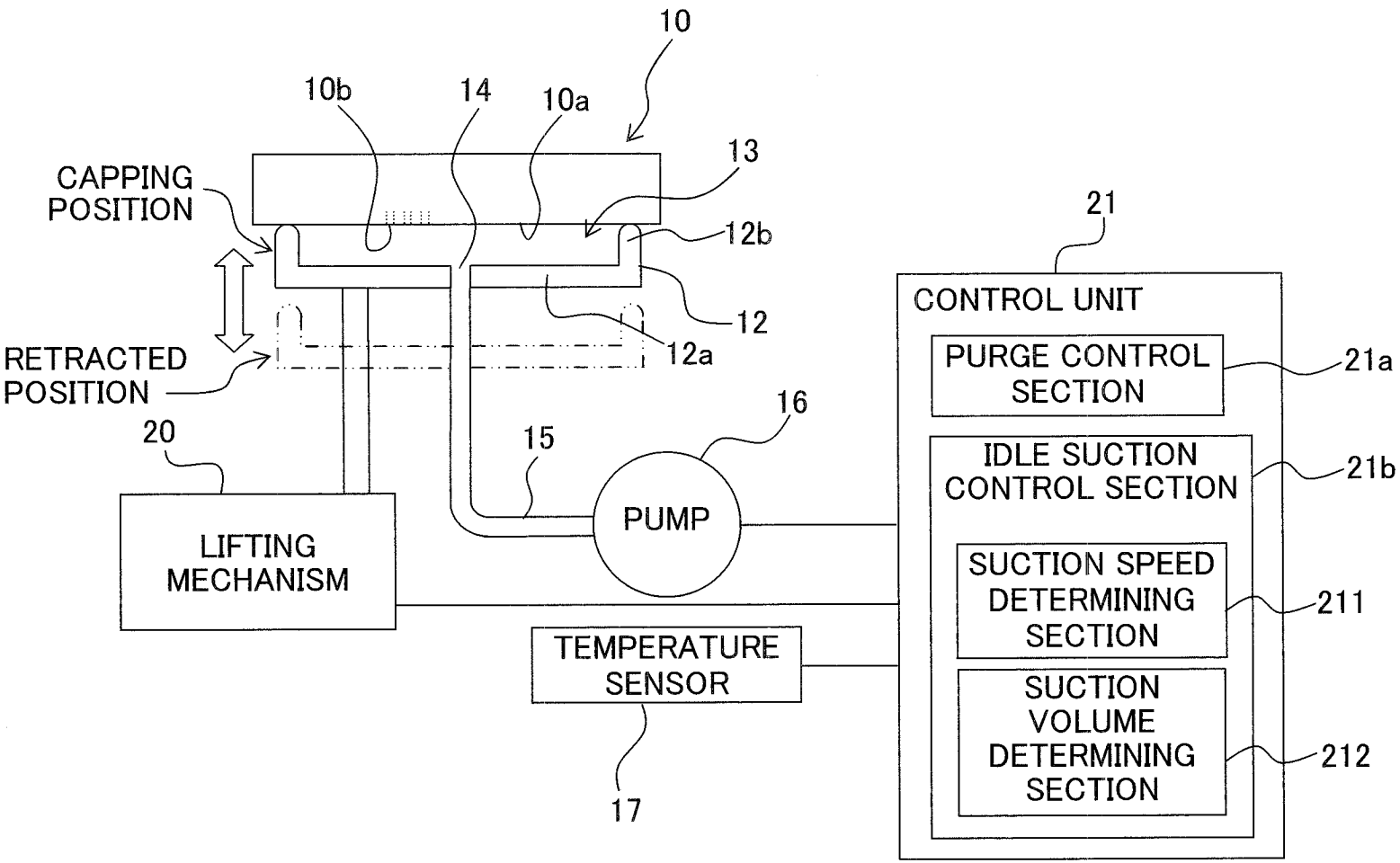
FIG. 2 schematically shows an arrangement in relation to the maintenance for the printer apparatus.

Next, an explanation will be made about an arrangement in relation to the maintenance for the printer apparatus 1. As shown in FIG. 2, the printer apparatus 1 is provided with the cap 12 which is provided under or below the jetting head 10 at the maintenance position 11. The cap 12 has a rectangular shape which is one size smaller than the jetting head 10 as viewed in a plan view. A circumferential wall portion 12*h* is provided upstandingly from four sides of an inner bottom portion 12*a*. The internal space, which is surrounded by the inner bottom portion 12*a* and the circumferential wall portion 12*b*, is the liquid storage space 13.

A lifting mechanism (moving mechanism) 20 is connected to the cap 12. The cap 12 is movable upwardly and downwardly between the upper position (capping position) at which the upper end portion of the circumferential wall portion 12*b* abuts against the nozzle surface 10*a* disposed on the lower surface of the jetting head 10 and the lower position (retracted position) at which the cap 12 is separated from the nozzle surface 10*a*. When the cap 12 abuts against the nozzle surface 10*a* at the upper position, the plurality of nozzle holes 10*b*, which are formed on the nozzle surface 10*a* for jetting the liquids, are in such a state that the plurality of nozzle holes 10*b* are surrounded inside by the cap 12 while being surrounded by the circumferential wall portion 12*b* (in a state that the plurality of nozzle holes 10*b* are open toward the liquid storage space 13).

A discharge hole 14, which penetrates through the inner bottom portion 12*a*, is formed for the inner bottom portion 12*a* of the cap 12. One end of a flexible suction tube 15 is connected to the discharge hole 14, and a suction pump (sucking mechanism) 16 is connected to the other end. Therefore, when the suction pump 16 is driven, it is possible to generate the negative pressure in the liquid storage space 13 of the cap 12 by the aid of the suction tube 15. Any suction pump can be appropriately selected as the suction pump 16 provided that the suction speed (pump suction amount per unit time) is changeable. In this embodiment, a known tube pump is adopted.

The tube pump includes a rotor (not shown) which has pressing (pressurizing) elements at circumferential portions, and a motor (not shown) which drives and rotates the rotor. One end of the suction tube 15 is connected to the cap 12, and the other end is connected to a waste liquid foam (not shown)

via the tube pump. The local pressing portion of the suction tube 15, which is pressed by the pressing element, is moved in accordance with the rotation of the rotor. Accordingly, the ink in the suction tube 15 can be sucked toward the tube pump. Owing to the arrangement as described above, the tube pump can prohibit the movement of the ink in the suction tube 15 as well when the operation is not performed. Any counterflow of the ink toward the cap 12 is avoided.

On the other hand, as shown in FIG. 2, the printer apparatus 1 is provided with a control unit 21 (controller). The control unit 21 includes unillustrated MPU (Micro Processing Unit), ROM (Read Only Memory) composed of, for example, PROM (Programmable Read-Only Memory) or mask ROM, and RAM (Random Access Memory). The suction pump 16, a temperature sensor 17 for detecting the environmental temperature in the vicinity of the jetting head 10, and the lifting mechanism 20 are connected to the control unit 21. At least the data and the program required to execute the maintenance operation including the idle suction operation described in this embodiment are recorded in ROM. The information in relation to the temperature detected by the temperature sensor 17 is temporarily recorded in RAM. MPU executes the predetermined program recorded in ROM with reference to the information recorded in RAM and the data recorded in ROM. Accordingly, the purge process and the idle suction process are executed as described later on. The control unit 21 includes a purge control section 21*a* and an idle suction control section 21*b*. The idle suction control section 21*b* includes a suction speed determining section 211 and a suction volume determining section 212. The control unit 21 also controls the lifting mechanism 20 described above to move the cap 12 upwardly and downwardly between the capping position and the retracted position. The temperature sensor 17 is provided in the printer apparatus 1 to detect the temperature in the printer apparatus 1. The temperature sensor 17 may be provided, for example, around the jetting head 10 to detect the temperature around the jetting head 10. Alternatively, the temperature sensor 17 may be provided around the cap 12 or the suction tube 15 to detect the temperature around the cap 12 or the suction tube 15.

Figure 3:
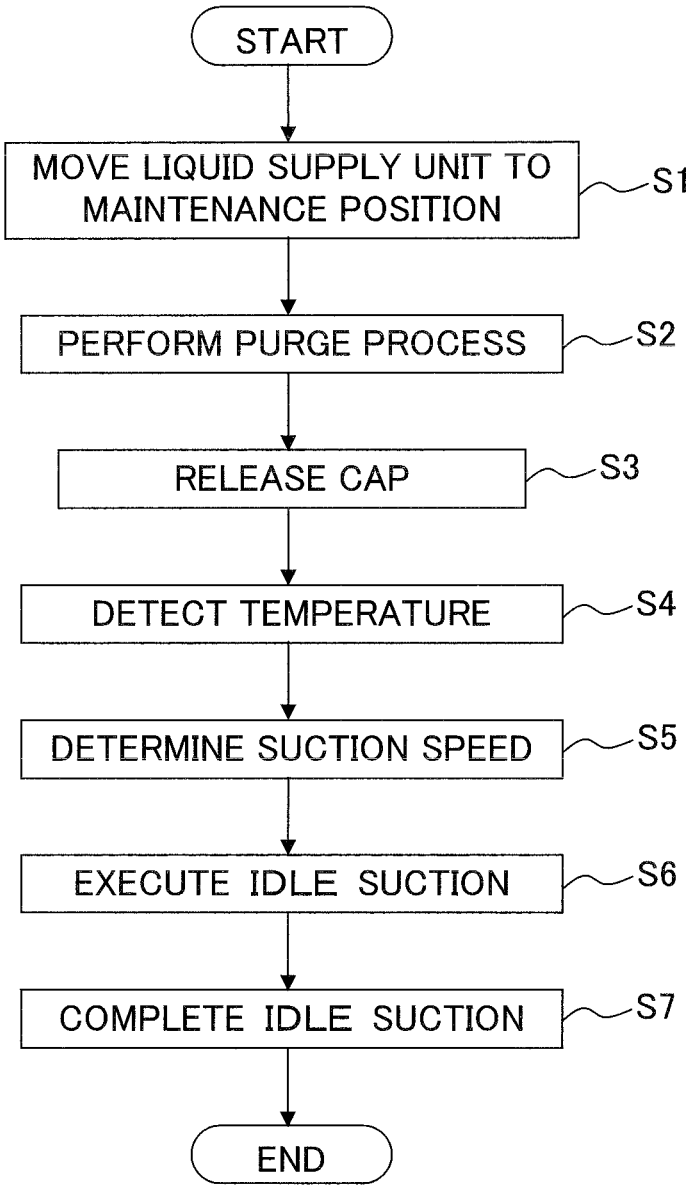
FIG. 3 shows a flow chart illustrating the idle suction operation in an embodiment of the present invention to be performed by the printer apparatus.

Next, the idle suction operation in this embodiment will be explained. As shown in FIG. 3, when the maintenance including the idle suction operation is executed, the liquid supply unit 4 is firstly moved to the maintenance position (Step S1). Subsequently, the control unit 21 drives the lifting mechanism 20 to move the cap 12 upwardly to the capping position so that the nozzle surface 10*a* of the jetting head 10 is covered with the cap 12. In this state, the purge control section 21*a* controls the suction pump 16 to drive the suction pump 16 at a predetermined speed by a predetermined amount so that the purge process is performed (Step S2). As a result of this process, a predetermined amount of the ink is discharged to the liquid storage space 13 of the cap 12. When the purge process is completed, the control unit 21 drives the lifting mechanism 20 again to move the cap 12 downwardly. Accordingly, the cap 12 is released from the nozzle surface 10, and the cap 12 is moved to the retracted position separated by the predetermined distance from the nozzle surface 10*a* (Step S3).

Subsequently, the temperature in the printer apparatus 1 is detected by the temperature sensor 17 (Step S4). The suction speed determining section 211 determines the suction speed as the operation condition for the suction pump 16 in order to perform the idle suction based on the detected temperature (Step S5).

Figure 4:
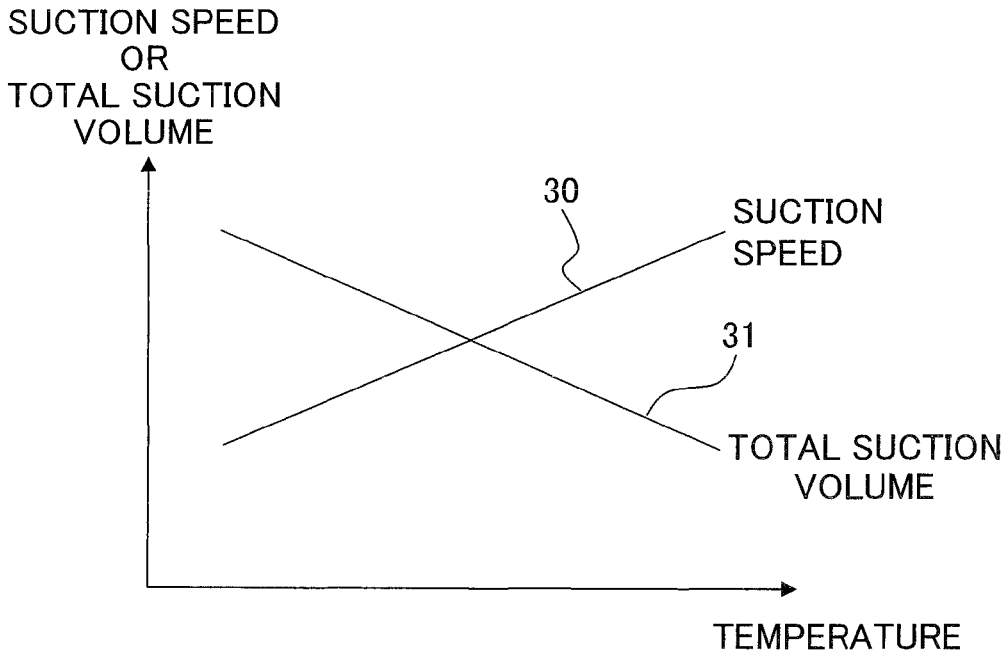

In general, as the temperature in the printer apparatus 1 becomes lower, the viscosity of the ink becomes higher (fluidity is decreased). Therefore, in order not to form an opening 35 at the liquid surface of the ink disposed just over the discharge hole 14, as shown in FIG. 4, it is preferable that the suction speed 30 for sucking the ink in the cap 12 is lowered as the temperature in the printer apparatus 1 is becomes lower. In view of the above, in Step S5, the speed of rotation (driving speed) of the pump 16 is lowered by the suction speed determining section 211 so that the suction speed is more lowered as the temperature in the printer apparatus 1 is more lowered. That is, the suction speed determining section 211 determines the suction amount per a predetermined period of time based on the temperature in the printer apparatus 1.

For example, the diameter of the discharge hole 14 of the cap 12, the inner diameter of the suction tube 15, and the amount (depth) of the ink discarded into the cap 12 by the purge process may be also the elements or factors to determine the suction speed of the pump 16. Therefore, when the speed is specifically determined, then the correlation data, which indicates the relationship between the temperature and the suction speed in consideration of the elements, may be previously recorded in ROM, and the suction speed may be determined from the detected temperature and the correlation data. The relationship between the elements and the suction speed may be preferably exemplified as follows by way of example. That is, under a constant temperature condition, as the diameter of the discharge hole 14 and/or the inner diameter of the suction tube 15 is/are smaller, and as the ink waste amount brought about by the purge process becomes smaller (the ink in the cap 12 is shallower), the suction speed is lowered.

With reference to the operation flow shown in FIG. 3 again, when the suction speed determining section 211 determines the suction speed based on the temperature in the printer apparatus 1 detected in Step S4 (Step S5), the idle suction control section 21*b* continuously drives the suction pump 16 in accordance with the suction speed determined by the suction speed determining section 211 to execute the idle suction (Step S6). Accordingly, the ink, which is in the liquid storage space 13 of the cap 12, is sucked via the discharge hole 14, and the ink is discharged to the waste liquid foam (not shown). The idle suction control section 21*b* stops the driving of the pump 16 to complete the idle suction operation, for example, at a point in time at which a predetermined period of time elapses or at a point in time at which a predetermined volume is completely sucked (Step S7).

When the idle suction operation is executed as described above, the ink, which is accumulated in the cap 12 after the purge, can be reliably sucked and discharged from the discharge hole 14.

Figure 5B:
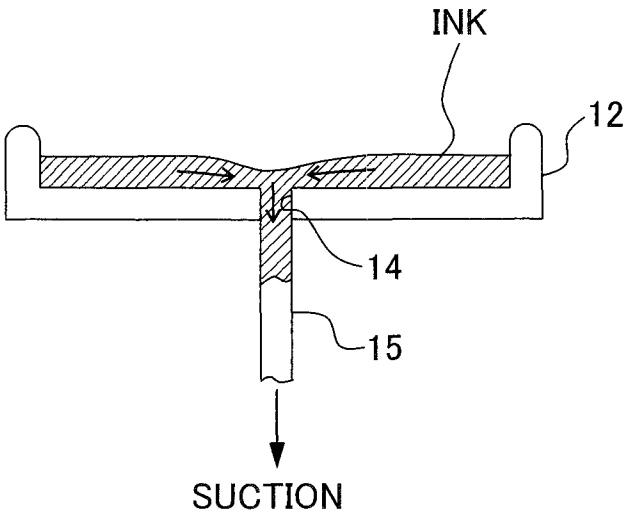
FIG. 5B shows Working Example provided when the operation is executed according to the embodiment of the present invention.
Figure 5A:
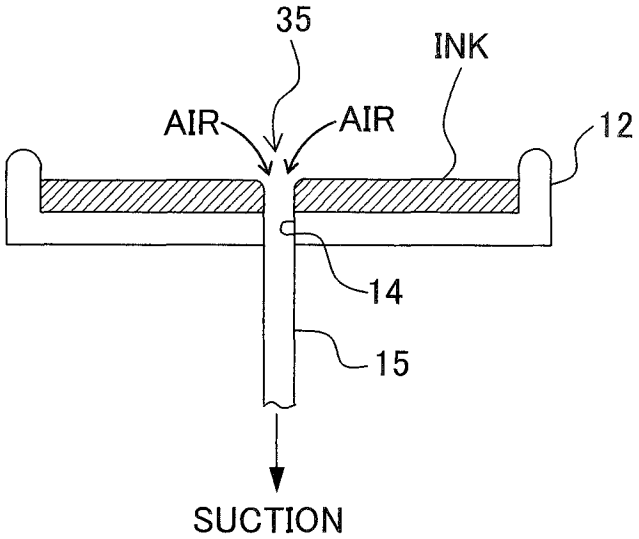
FIG. 5A shows Comparative Example in which the idle suction is performed at a relatively high speed irrelevant to the environmental temperature.

For example, if the idle suction is performed at a high suction speed when the viscosity of the ink is high (fluidity is small), then only the ink, which is disposed in the vicinity of the discharge hole 14 of the cap 12, is discharged from the discharge hole 14 while being separated from the surrounding ink, and the surrounding ink remains in the cap 12. Therefore, as shown in FIG. 5A, it is considered that the opening 35, which is continuous to the discharge hole 14, is formed at the liquid surface just over the discharge hole 14 to give a state in which the opening 35 and the discharge hole 14 are communicated with each other. In this situation, even when the suction pump 16 is further driven, then the air, which has the small suction resistance, is sucked through the opening 35 into the discharge hole 14, and the ink, which is disposed around the discharge hole 14, is hardly sucked. On the contrary, in the case of this embodiment, the idle suction is performed at the appropriate suction speed corresponding to the temperature in the printer apparatus 1. Therefore, the situation, in which only the ink disposed in the vicinity of the discharge hole 14 of the cap 12 is discharged from the discharge hole 14 while being separated from the surrounding ink, is avoided. As shown in FIG. 5B, the opening 35, which is continuous to or communicated with the discharge hole 14, is not formed at the liquid surface. Therefore, the air is not sucked into the discharge hole 14. The ink in the cap 12 is moved toward the discharge hole 14, and the ink is efficiently sucked.

Next, an explanation will be made about Example of the idle suction operation described above. In Example, a suction pump 16, which had a suction amount per one rotation or revolution of 0.2 ml, was used to suck about 0.3 ml of the ink in the cap 12. The viscosities of the ink in the cap 12 at 25° C. and 15° C. are 3.0 mPa·s and 3.8 mPa·s respectively. The following fact has been visually confirmed. That is, when the suction pump 16 is driven at a velocity (speed) of rotation of 28 rpm when the temperature in the printer apparatus 1 detected by the temperature sensor 17 is 25° C., then the opening, which is continuous to or communicated with the discharge hole 14, is not formed at the liquid surface of the ink in the cap 12, and the ink is discharged smoothly. On the other hand, the following fact has been visually confirmed. That is, when the suction pump 16 is driven at a velocity of rotation of 19 rpm when the temperature in the printer apparatus 1 detected by the temperature sensor 17 is 15° C., then the opening, which is continuous to or communicated with the discharge hole 14, is not formed at the liquid surface of the ink contained in the cap 12, and the ink is discharged smoothly.

Figure 6:
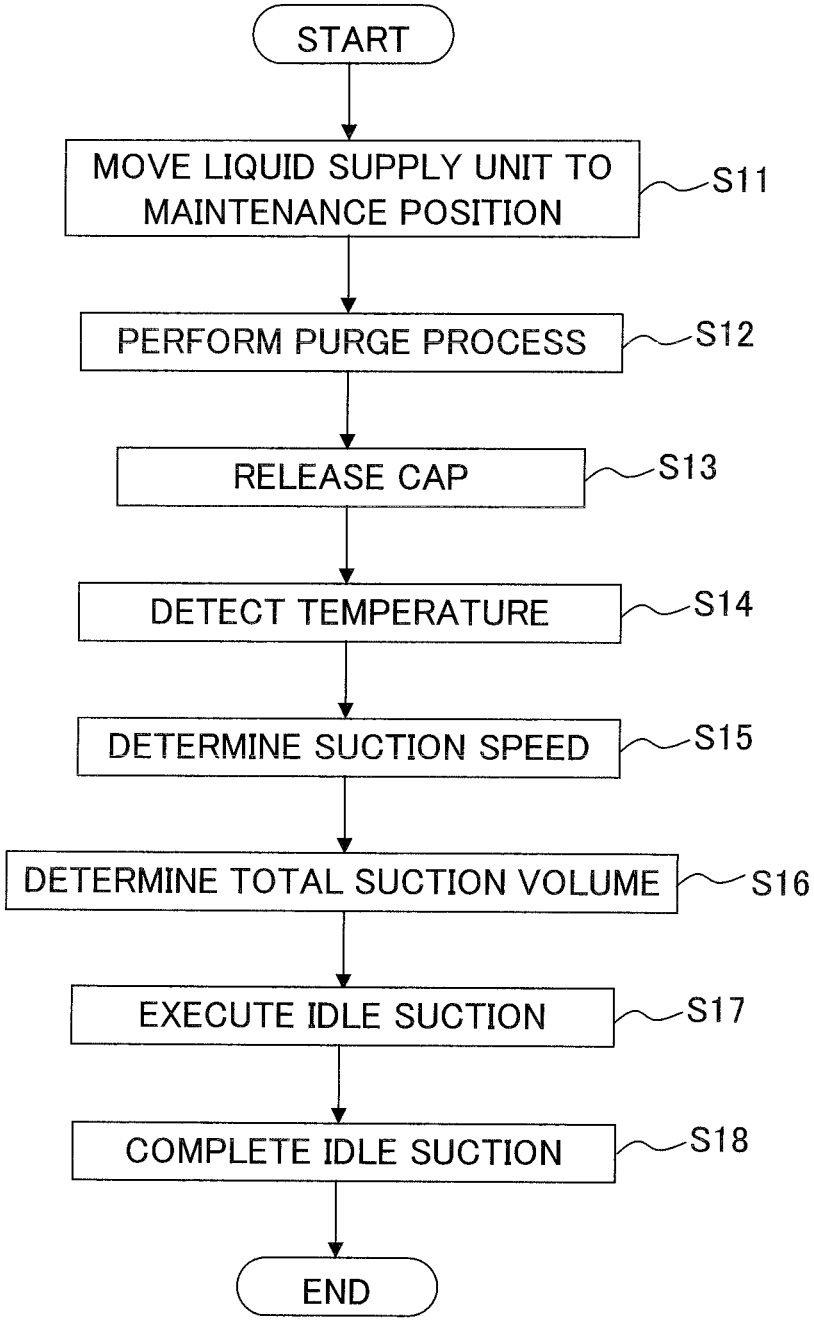
FIG. 6 shows a flow chart illustrating a first modified embodiment of the idle suction operation.

Next, a first modified embodiment of the idle suction operation will be explained with reference to FIG. 6. In the first modified embodiment, as shown in FIG. 6, the operations of Steps S11 to S15, which include the same contents as those of the operations of Steps S1 to S5 shown in FIG. 3, are executed. Further, in Step S15, the suction speed is determined as the operation condition of the suction pump 16. After that, the suction volume determining section 212 determines the total suction volume (capacity) as another operation condition of the suction pump 16 for the idle suction based on the temperature in the printer apparatus 1 detected in Step S14 (Step S16).

In this case, the total suction volume is determined by the total number of revolutions (total angle of rotation) of the suction pump 16 (tube pump provided with the rotor). Therefore, in order to determine the total suction volume, it is appropriate to determine the total number of revolutions of the suction pump. As shown in FIG. 4, it is preferable that the total suction volume 31, i.e., the total number of revolutions of the suction pump 16 is more increased as the temperature is more lowered. This is based on the following knowledge of the present inventors. That is, if the same amount of the ink is sucked, when the temperature is high, then the viscosity of the ink is lowered, and the ink itself tends to flow with ease (fluidity is large). Accordingly, the ink can be easily discharged from the discharge hole 14 even when the total number of revolutions of the suction pump 16 is small. However, when the temperature is low, then the viscosity of the ink is raised, and the ink itself hardly flows (fluidity is decreased). Accordingly, the ink cannot be discharged with ease unless the total number of revolutions of the suction pump 16 is increased. Therefore, in Step S16, the suction volume determining section 212 determines the total number of revolutions of the pump 16 so that the total suction volume is more increased as the temperature in the printer apparatus 1 is more lowered.

The idle suction control section 21*b* drives the suction pump 16 at the suction speed determined in Step S15 to execute the idle suction (Step S17). The driving of the suction pump 16 is stopped at a point in time at which the total suction volume determined in Step S16 has been sucked, and the idle suction comes to an end (Step S18).

When the idle suction operation is executed as described above, the ink, which is accumulated in the cap 12 after the purge, can be sucked and discharged from the discharge hole 14 more reliably.

Figure 7:
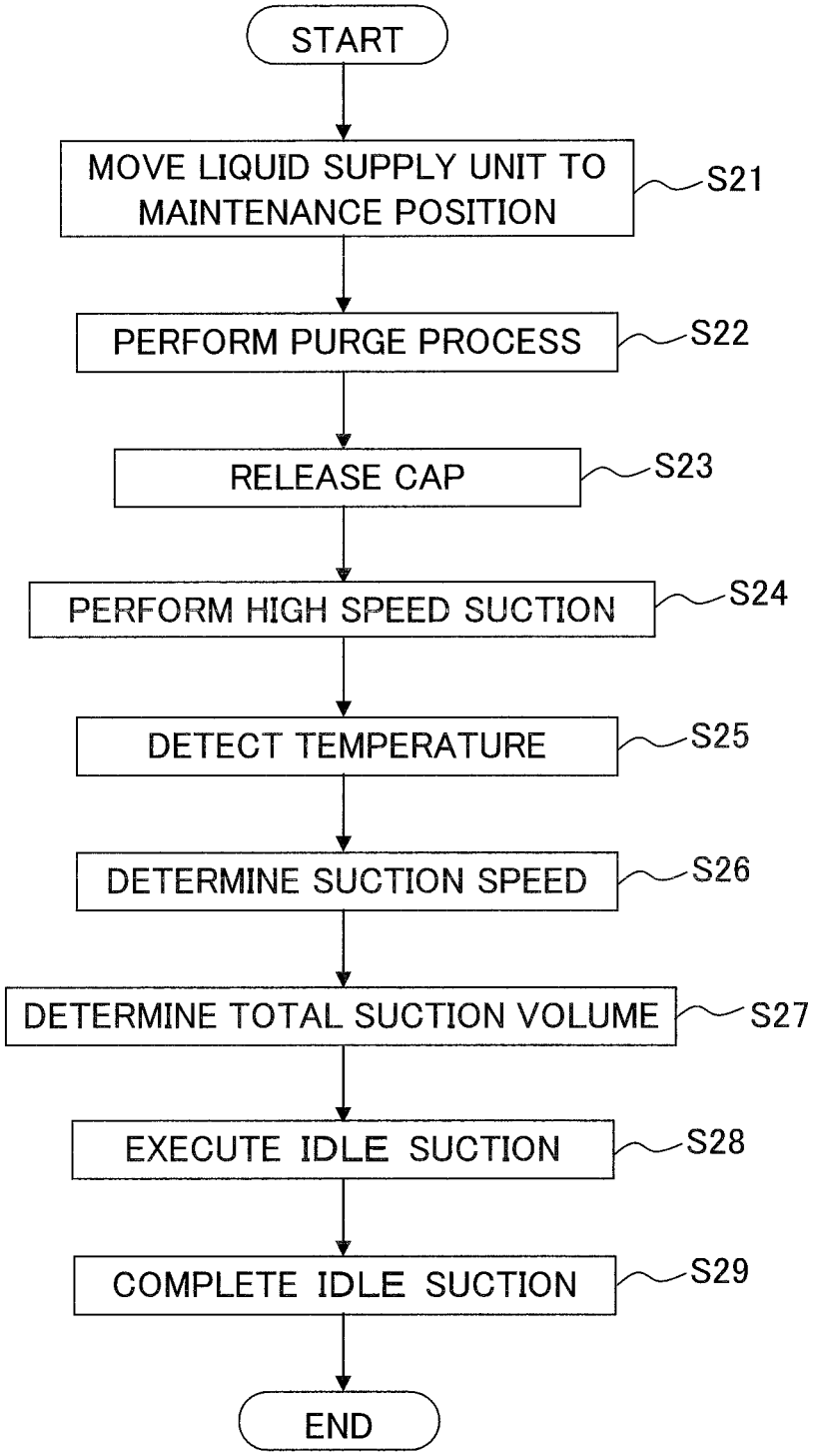
FIG. 7 shows a flow chart illustrating a second modified embodiment of the idle suction operation.

Next, a second modified embodiment of the idle suction operation will be explained with reference to FIG. 7. As shown in FIG. 7, the second modified embodiment includes the operations of Steps S21 to S23 and S25 to S29 which include the same contents as those of the operations of Steps S11 to S13 and S14 to S18 shown in FIG. 6 in the first modified embodiment. However, unlike those shown in FIG. 6, a process (Step S24) is provided, in which the suction pump 16 is driven at a high speed for a predetermined period of time after releasing the cap 12 from the nozzle surface 10*a* (Step S23).

When the cap 12 is released from the nozzle surface 10*a*, then the ink, which is discharged into the cap 12 in accordance with the previous purge process (Step S22), is adhered to a part of the nozzle surface 10*a*, and the ink sometimes forms the so-called ink bridge ranging over the space between the nozzle surface 10*a* and the cap 12. Therefore, when the suction pump 16 is driven at the high speed for the predetermined period of time (Step S24) after releasing the cap 12, then the ink can be cut and separated from the nozzle surface 10*a* early, and it is possible to extinguish or dissipate the ink bridge.

The driving condition of the suction pump 16 in Step S24 is not limited to those set by the time. The driving condition may be set in accordance with the number of revolutions (angle of rotation) for the tube pump according to the embodiment of the present invention. As for the driving speed, it is appropriate that the speed is greater than at least the suction speed of the suction pump 16 in the idle suction (Step S28). The driving speed may be constant irrelevant to the temperature in the printer apparatus 1.

However, it is also appropriate that the suction speed in Step S24 is changed depending on the temperature in the printer apparatus 1. In this case, the process in Step S24 may be executed until the process of the idle suction operation (Step S28) after the process for detecting the temperature in the printer apparatus 1 (Step S25). As in the procedure explained with reference to the flow chart shown in FIG. 3, it is also possible to omit Step S27 of determining the total suction volume.

Figure 8:
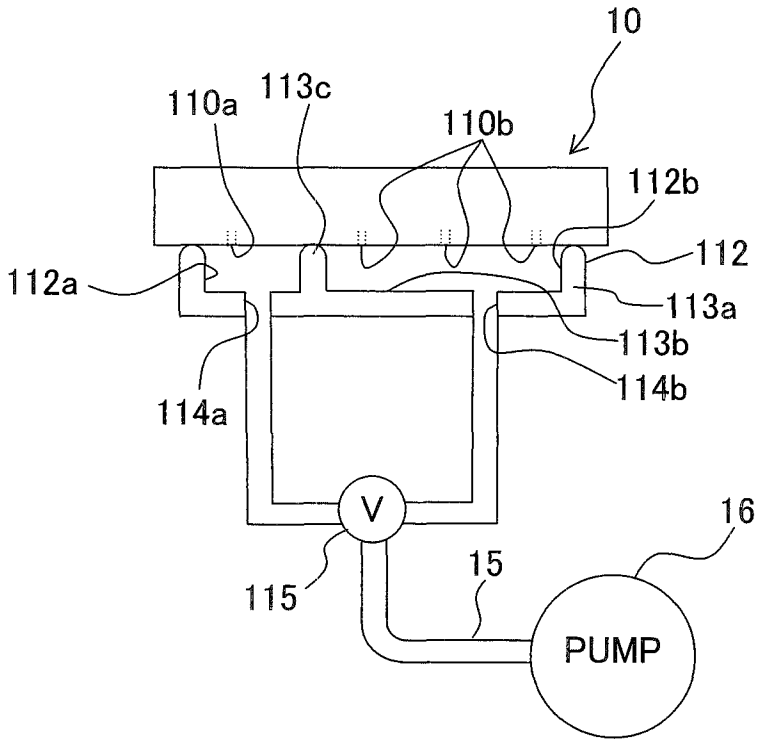
FIG. 8 schematically shows a modified embodiment concerning a cap and a suction pump.

Next, a modified embodiment concerning the cap and the suction pump will be explained. As shown in FIG. 8, a cap 112 is comparted into a first cap section 112*a* and a second cap section 112*b* by a circumferential wall portion 113*a* and a projection 113*c* projecting from an inner bottom portion 113*b*. The upper end portion of the projection 113*c* abuts against the nozzle surface 10*a* of the jetting head 10 at the capping position. At the capping position, the first cap section 112*a* covers nozzle holes 110*a* for jetting the black ink (first liquid), and the second cap section 112*b* covers nozzle holes 110*b* for jetting the color inks (second liquids) having the viscosities higher than that of the black ink, including, for example, the cyan ink, the magenta ink, and the yellow ink. A first discharge hole 114*a* is formed at a portion of the inner bottom portion 113*b* corresponding to the first cap section 112*a*, and a second discharge hole 114*b* is formed at a portion corresponding to the second cap section 112*b*. The pump 16 is switchably or selectively connected to the first discharge hole 114*a* and the second discharge hole 114*b* via a changeover valve 115. The black ink, which is discharged to the first cap section 112*a*, is sucked via the first discharge hole 114*a*. The color inks, which are discharged to the second cap section 112*b*, are sucked via the second discharge hole 114*b*.

In general, when the temperature is constant, then the black ink has a low viscosity, and the black ink flows with ease as compared with the color inks. Therefore, when the temperature in the printer apparatus 1, which is detected by the temperature sensor 17, is constant in the structure or arrangement as described above, the suction speed determining section 211 may determine the driving speed so that the driving speed of the suction pump 16, which is provided when the black ink is sucked from the first cap section 112*a*, is higher than the driving speed of the suction pump 16 which is provided when the color inks are sucked from the second cap section 112*b*.

In general, when the temperature is changed from a first temperature to a second temperature which is higher than the first temperature, the viscosity of the black ink is lowered to a greater extent as compared with the color inks. Therefore, when the temperature in the printer apparatus 1 is changed from the first temperature to the second temperature which is higher than the first temperature in the structure or arrangement as described above, the suction speed determining section 211 may determine the driving speed of the suction pump 16 so that the amount of increase in the driving speed of the suction pump 16, which is provided when the black ink is sucked from the first cap section 112*a*, is greater than the amount of increase in the driving speed of the suction pump 16 which is provided when the color inks are sucked from the second cap section 112*b*.

In the embodiment of the present invention described above, any member, which is provided in order to absorb the ink in the cap, is not arranged on the inner bottom portion 12*a* of the cap 12. However, for example, an ink-absorbing member, which is composed of a porous material such as sponge or the like, may be arranged in the cap 12 so that the inner bottom portion 12*a* is covered therewith. Further, although the discharge hole 14 is formed in the inner bottom portion 12*a* of the cap 12, the discharge hole 14 may be formed in a lower part of the circumferential wall portion 12*b*. In this case, in order to prevent the ink from remaining in the liquid storage space 13 of the cap 12, the discharge hole 14 is formed in the lower part of the circumferential wall portion 12*b* so that lower end of the discharge hole 14 and the inner bottom portion 12*a* are the same in height. The inner bottom portion 12*a* and the lower part of the circumferential wall portion 12*b* are included in the bottom portion of the claims.

In the embodiment of the present invention described above, the idle suction control section 21*b* executes the idle suction by continuously driving the suction pump 16 at the suction speed determined by the suction speed determining section 211 when the ink discharged into the cap 12 is sucked by the suction pump 16 via the discharge hole 14. However, the driving method for driving the suction pump 16 is not limited thereto. For example, the suction pump 16 may be driven intermittently so that the suction pump 16 is driven at a constant driving speed while a period of time, in which the driving is interrupted, is included during the driving time. In this procedure, the suction amount per a predetermined period of time can be changed by changing the period of time in which the driving is interrupted, without changing the driving speed of the suction pump 16, depending on the temperature in the printer apparatus 1. In other words, the period of time, in which the driving of the suction pump 16 is interrupted, is more prolonged as the temperature in the printer apparatus 1 is more lowered. Accordingly, even when the speed of the suction pump 16 during the driving is retained to be constant, the ink, which is discharged into the cap 12, can be reliably sucked. Alternatively, not only the period of time in which the driving is interrupted but also the driving speed of the suction pump 16 may be changed depending on the temperature in the printer apparatus 1. In this case, the suction pump 16 may be driven intermittently so that the period of time, in which the driving of the suction pump 16 is interrupted, is more prolonged, and the speed of the suction pump 16 during the driving is more lowered, as the temperature in the printer apparatus 1 is more lowered. In accordance with the way of the driving of the suction pump 16 as described above, the ink in the cap 12 can be sucked more reliably. Further, it is also appropriate to combine the continuous driving and the intermittent driving of the suction pump 16. For example, when the temperature in the printer apparatus 1 is high, the suction pump 16 may be driven continuously at a high driving speed. As the temperature is lowered, the driving speed of the suction pump 16 may be lowered, and the period of time, in which the driving is interrupted, may be prolonged so that the suction pump 16 may be driven intermittently.

In the embodiment of the present invention described above, the driving speed of the suction pump 16 is determined depending on the temperature in the printer apparatus 1 irrelevant to the color of the ink discharged into the cap 12. However, the driving speed of the suction pump 16 may be determined for each color of the ink when only the ink of the concerning color is discharged into the cap 12. When the temperature in the printer apparatus 1 is constant, the viscosity generally differs depending on each color of the ink as well. Therefore, when the first ink is sucked from the cap 12 to which only the first ink is discharged, the idle suction control section 21*b* may drive the suction pump 16 at a first driving speed. When the second ink is sucked from the cap 12 to which only the second ink having the viscosity higher than that of the first ink is discharged, the idle suction control section 21*b* may drive the suction pump 16 at a second driving speed which is lower than the first driving speed. Further, when both of the first ink and the second ink are discharged into the cap 12, then the suction pump 16 may be driven at the second driving speed to be used when the second ink having the higher viscosity is sucked, and the first and second inks may be sucked from the cap 12. In other words, when a plurality of inks, which have different viscosities, are discharged into the cap 12, the suction pump 16 may be driven at the driving speed to be used when the ink is sucked from the cap 12 to which only the ink having the highest viscosity is discharged.

In the embodiment of the present invention described above and the first and second modified embodiments concerning the idle suction operation, the purge process (Steps S2, S12, S22), in which the suction pump 16 is driven to discharge the ink from the nozzle holes 10*b* in the state that the nozzle surface 10*a* of the jetting head 10 is covered with the cap 12, as the maintenance operation for the jetting head 10 to be performed before the idle suction operation. However, the maintenance operation for the jetting head 10 is not limited to the purge process. It is also allowable to perform flashing operation in which an actuator (not shown) for jetting the ink provided for the jetting head 10 is driven to discharge the ink from the nozzle holes 10*b* into the cap 12.

In the embodiment of the present invention described above and the first and second modified embodiments concerning the idle suction operation, the process (Steps S4, S14, S25) for detecting the temperature in the printer apparatus 1 is executed after the release operation (Steps S3, S13, S23) for releasing the cap 12. However, the timing, at which the temperature in the printer apparatus is detected, is not limited to the timing provided after the release operation for releasing the cap 12. The process may be executed, for example, during the purge process (Steps S2, S12, S22).

In the first modified embodiment concerning the idle suction operation described above, the process (Step S16) for determining the total suction volume is executed after the process (Step S15) for determining the suction speed. However, the determining processes may be executed in a reverse order or sequence.

The exemplary embodiments, in which the present invention is applied to the printer apparatus, have been explained above. However, the present invention is not limited to the application to the printer apparatus. The present invention is also applicable to all liquid jetting apparatuses for jetting any liquid other than the ink.

What is claimed is:

1. A liquid jetting apparatus which jets a liquid, comprising:

a jetting head which has a nozzle surface formed with a plurality of nozzle holes and which jets the liquid from the nozzle holes;

a cap which has a bottom portion formed with a discharge hole and which covers the nozzle surface of the jetting head;

a pump which sucks the liquid in the cap via the discharge hole;

a moving mechanism which moves the cap between a capping position at which the cap covers the nozzle holes and a retracted position at which the cap is separated from the jetting head;

a temperature sensor which detects a temperature in the liquid jetting apparatus; and a controller which is configured to control the jetting head, the pump, and the moving mechanism, wherein in a state that the cap is positioned at the controller is configured to control one of the jetting head and the pump to discharge the liquid in the jetting head from the nozzle holes into the cap; and wherein after the liquid in the liquid jetting head has been discharged from the nozzle holes into the cap, the controller is configured to:

controls the moving mechanism to move the cap to the retracted position; and in a state that the cap is positioned at the retracted position, control the pump to drive for a first length of time at a first rotation number per unit time under a condition that a temperature detected by the temperature sensor is a first temperature, and to drive for a second length of time longer than the first length of time at a second rotation number per unit time which is smaller than the first rotation number per unit time under a condition that the temperature detected by the temperature sensor is a second temperature which is lower than the first temperature, so that the liquid discharged into the cap is sucked via the discharge hole.

2. The liquid jetting apparatus according to claim 1, wherein the controller determines a driving speed of the sucking mechanism based on the temperature detected by the temperature sensor to intermittently drive the sucking mechanism at the driving speed, and to suck the liquid discharged into the cap.

3. The liquid jetting apparatus according to claim 2, wherein as the temperature in the liquid jetting apparatus detected by the temperature sensor is lower, the controller determines a period of time for interrupting the driving of the sucking mechanism to be longer.

4. The liquid jetting apparatus according to claim 1, wherein the temperature sensor detects the temperature in the liquid jetting apparatus when the controller controls the pump to discharge the liquid in the jetting head from the nozzle holes into the cap.

* * * * *